United States Patent [19]

Schneider, Jr.

[11] 4,034,673

[45] July 12, 1977

[54] ARMOR PENETRATION SHAPED-CHARGE PROJECTILE

[75] Inventor: Clayton J. Schneider, Jr., East Aurora, N.Y.

[73] Assignee: Calspan Corporation, Buffalo, N.Y.

[21] Appl. No.: 660,557

[22] Filed: Feb. 23, 1976

[51] Int. Cl.[2] ..... F42B 13/10

[52] U.S. Cl. ..... 102/56 SC; 102/24 HC

[58] Field of Search ..... 102/24 HC, 39, 56 SC; 89/1 B

[56] References Cited

U.S. PATENT DOCUMENTS

| | | | |
|---|---|---|---|
| 3,109,373 | 11/1963 | Saffer, Jr. | 102/24 HC |
| 3,565,009 | 2/1971 | Allred | 102/56 SC |
| 3,714,897 | 2/1973 | Parker | 102/24 HC |
| 3,840,246 | 10/1974 | McCullough, Jr. et al. | 102/39 |
| 3,949,674 | 4/1976 | Talley | 102/56 SC |

FOREIGN PATENT DOCUMENTS

| | | | |
|---|---|---|---|
| 1,520,577 | 3/1968 | France | 102/24 HC |
| 2,254,879 | 5/1973 | Germany | 102/24 HC |
| 124,913 | 5/1949 | Sweden | 102/56 SC |

*Primary Examiner*—Verlin R. Pendegrass
*Attorney, Agent, or Firm*—Allen J. Jaffe

[57] ABSTRACT

A shaped-charge projectile having a cylindrical chamber containing a main charge, a fluted liner projecting into the chamber and means causing the liner to expand upon impact with a target and prior to firing of the main charge to thereby increase the penetrating power of the projectile. According to one aspect the means comprises a pyrotechnic material located within the liner, according to a second aspect the means comprises a ram driven into the liner and according to a third aspect the means comprises a plurality of rigid rods fixed to the flutes of the liner.

16 Claims, 11 Drawing Figures

ARMOR PENETRATION SHAPED-CHARGE PROJECTILE

BACKGROUND OF THE INVENTION

The present invention relates to projectiles and, more particularly, to armor penetrating, shaped-charge projectiles. Among the techniques for penetration of armor-protected targets, the shaped charge high-explosive configuration is perhaps the best known. Generally, this configuration is typified by a high explosive chamber bounded at one end by a substantially conical liner projecting into high explosive material. Upon detonation of the explosive, a detonation wave proceeds towards the target producing, from the liner, a high-velocity jet of material directed towards the target to penetrate the same. The phenomenon, known as the Monroe Effect, by which the detonation wave divides about the apex of the conical liner and then recombines to produce a jet of higher velocity than the original detonation wave, is well known.

The damage or penetration potential of the shaped charge depends, among other things, on the liner diameter. Thus, although some improvements in penetrating power of a shaped charge projectile can be accomplished by optimization of the explosive, the liner, standoff or the like, a fundamental parameter of effectiveness is the diameter of the charge or the base diameter of the conical liner. However, increasing the diameter of the charge increases the bulk, size and weight of the projectile and would be subject to all the logistic problems associated with larger caliber projectiles. These factors prior to the present invention, have restricted the use of shaped charge projectiles in lightweight gun systems.

SUMMARY OF THE INVENTION

The foregoing disadvantages, as well as others, of the prior art are overcome according to the teachings of the present invention which provides the advantages of a large diameter liner in a lightweight small diameter projectile whereby for the same sized projectile greater penetration power is achieved than heretofore.

Basically the present invention provides a chamber containing a high explosive, one end of which is bounded by a relatively thin cross-sectioned liner which projects into said chamber forming a depression and means for expanding the liner outwardly prior to detonation of the high explosive.

According to one aspect of the present invention the means for expanding the liner may comprise an explosive detonation located within the depression which is actuated upon impact with a target and prior to actuation of the main explosive detonator.

According to a second aspect of the present invention the means for expanding the liner may comprise a mechanically actuated ram which forces the liner to expand upon impact. Alternatively, a pyrotechnic actuated ram may be employed.

BRIEF DESCRIPTION OF THE DRAWINGS

For a fuller understanding of a present invention reference should now be had to the following detailed description thereof taken in conjunction with the accompanying drawings wherein.

DESCRIPTION OF THE PREFERRED EMBODIMENTS

Figure 1:
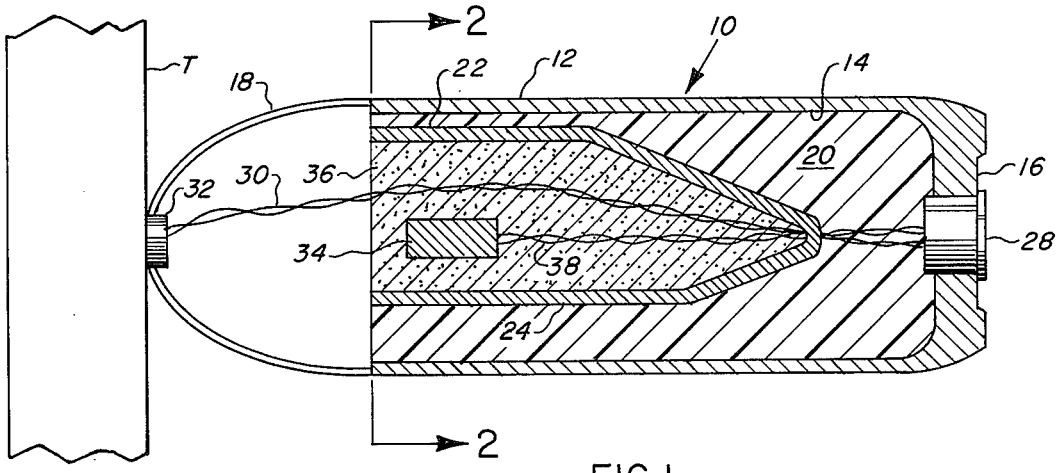
FIG. 1 is a cross-sectional view of the projectile of the present invention containing the expandable liner.
Figure 2:
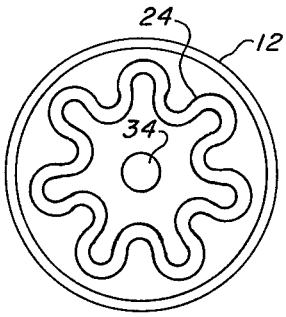
FIG. 2 is a sectional view taken along line 2 — 2 of FIG. 1.
Figure 3:
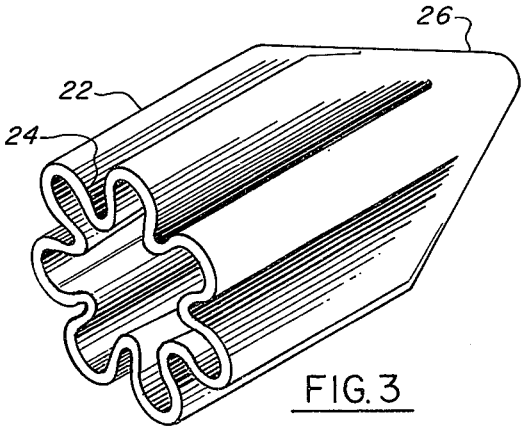
FIG. 3 is a pictorial view of the liner of FIG. 1.
Figure 4:
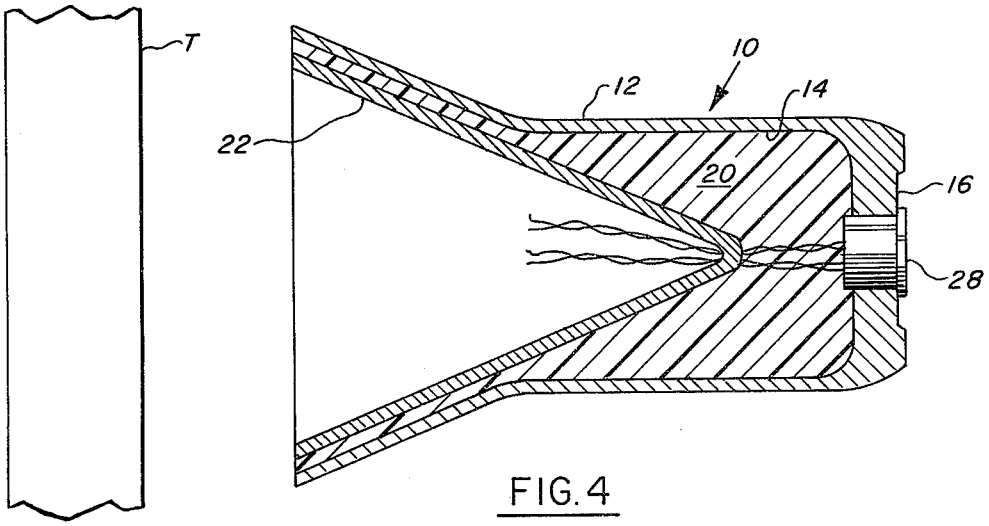
FIG. 4 is a schematic fragmentary view similar to FIG. 1 illustrating the liner in its expanded position after projectile contact with the target.
Figure 5:
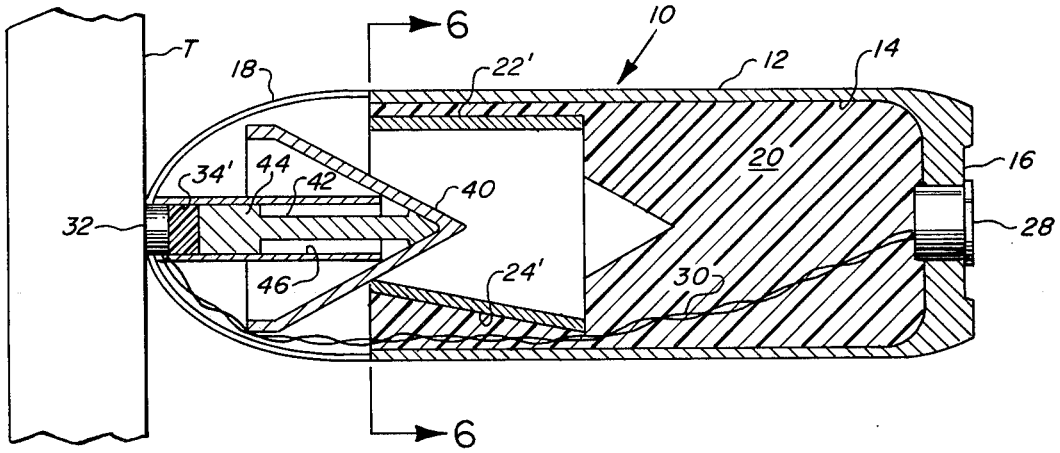
FIG. 5 is a fragmentary sectional view similar to FIG. 1 illustrating a second embodiment.
Figure 6:
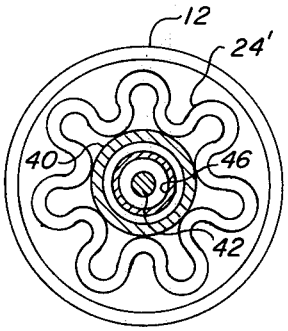
FIG. 6 is a sectional view taken along line 6 — 6 of FIG. 4.
Figure 7:
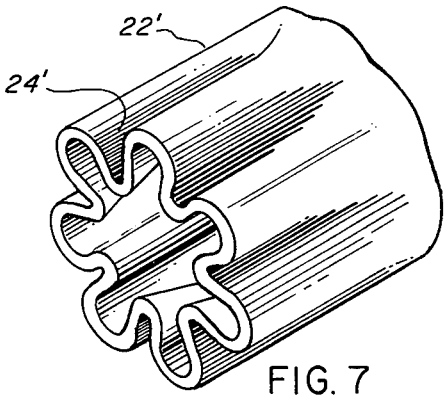
FIG. 7 is a fragmentary pictorial view of the line of FIG. 5.

Referring now to the drawings and, more particularly, to FIGS. 1 – 4, the projectile according to the present invention is generally depicted at 10 and is shown as comprised a generally cylindrical, hollow housing 12 defining an interior chamber 14 closed at one end by wall 16. As is conventional, a windshield 18 is suitably attached to the other end of the projectile chamber.

A pyrotechnic material 20 substantially fills chamber 14 and may comprise any well known material such as C3, C4 or any other flexible detonating explosive. The expansible liner 22, according to the present invention, projects into chamber 14 and pyrotechnic 20. As shown more clearly in FIGS. 2 and 3, liner 22 has a longitudinally fluted perimeter 24 terminating in a tapered end 26. The arrangement is such that the maximum flute diameter is normally no greater than the diameter of housing 12.

Wall 16 of projectile 10 contains a conventional point initiating base detonating fuze 28, having lead wires 30 connected to a piezoelectric or the like initiating element 32 located at the tip of windshield 18, as is also conventional.

Means are provided to expand the liner 22 upon contact between a target T and the initiating element 32. In the FIGS. 1 - 4 embodiment such means comprises an explosive charge 34 located within liner 22 and suitably supported by foam 36 or the like. Charge 34 may be one of a wide variety of well known detonating or deflagrating explosives. To effectuate detonation of charge 34 prior to main charge 20 fuze 28 may contain an electrical, mechanical or pyrotechnic delay element as is well known. Suitable leads 38 are provided between detonator 28 and charge 34.

The liner 22 may be fabricated of any suitable material such as, for example, glass, copper or lead the thickness of which is a function of well known design variables such as quantity of main charge 20, size of projectile, intended depth of penetration and the like. Windshield 18 may be fabricated of thin sheet steel, for example and is frangibly connected to the projectile housing to fall away upon impact as is well known.

The operation of the embodiment of FIGS. 1 – 4 will now be discussed. When the initiating element 32 and windshield 18 impact upon a target, the windshield falls away whereas a signal is transmitted by element 32 to fuze 28 which, in turn, delivers an actuating signal to liner charge 34 which fires causing the fluted liner to expanded into the substantially conical shape of FIG. 4 having an outer dimension much larger than the original outer dimension of the projectile. A short time after firing of liner charge 34, say one microsecond, main charge 20 is fired causing the liner to collapse creating a jet projecting slug which penetrates the target in the conventional manner. However, since the liner has been enlarged much greater penetrating power is realized than would be the case if the liner did not expand prior to the firing of the main charge. Thus, the advantages of a large liner are realized without the detriments thereof.

Other means for expanding the liner may be employed within the scope of the present invention. For example, FIGS. 5 – 8 illustrate a first alternative embodiment wherein the same numerals refer to parts the are the same as the previous embodiment and primes are used to indicate modified parts. Thus, the liner 22′ has longitudinally extending circumferential flutes 24′ and there is provided a substantially conical ram 40 adjacent the hollow interior of the liner and coaxial therewith. Suitably affixed to the interior of the ram is a piston rod 42 terminating in a piston 44 which is slidingly received in a cylinder 46 suitably fixed to windshield 18. A liner charge 34′, similar to charge 34 of the previously described embodiment, is located between initiating element 32 and piston 44 within cylinder 46.

Figure 8:
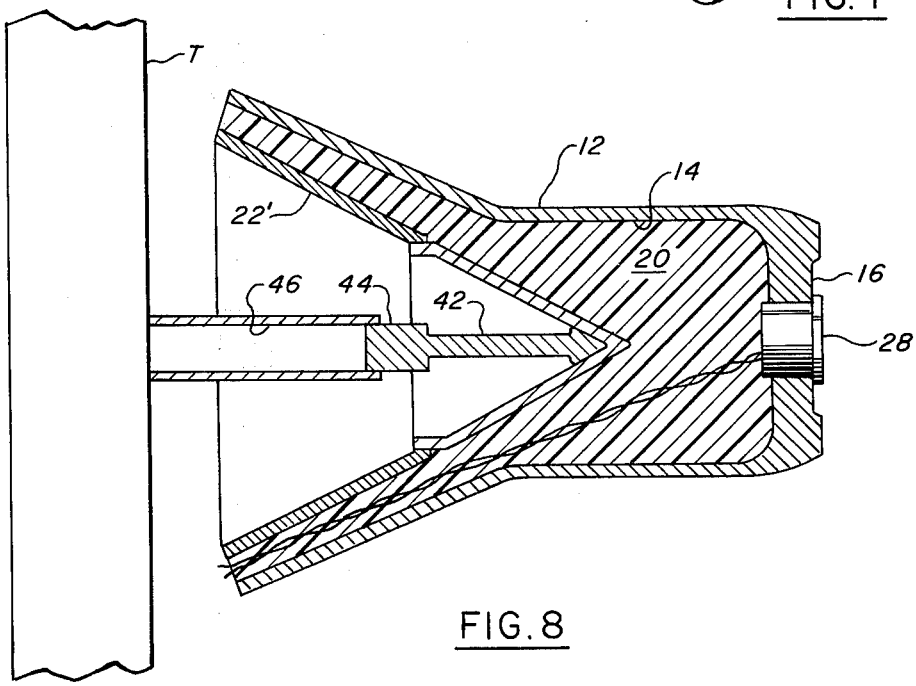
FIG. 8 is a view similar to FIG. 5 illustrating the liner thereof in its expanded position after projectile contact with the target.

In the operation of the FIGS. 5 – 8 embodiment, when initiating element 32 contacts the target T charge 34′ is fired, the explosive pressures of which force piston and ram 40 into intimate contact with the interior flutes of liner 22′ causing the same to expand into the substantially conical shape of FIG. 8. At which point main charge 20 is fired and the target is penetrated in the well known manner. As in the previous embodiment the expanded liner has an outer dimension much larger than the original outer dimension of the projectile permitting greater penetration of the target. Although ram 40 is actuated by charge 34′, the same could obviously be actuated by the mechanical forces developed upon impact with the target.

Figure 9:
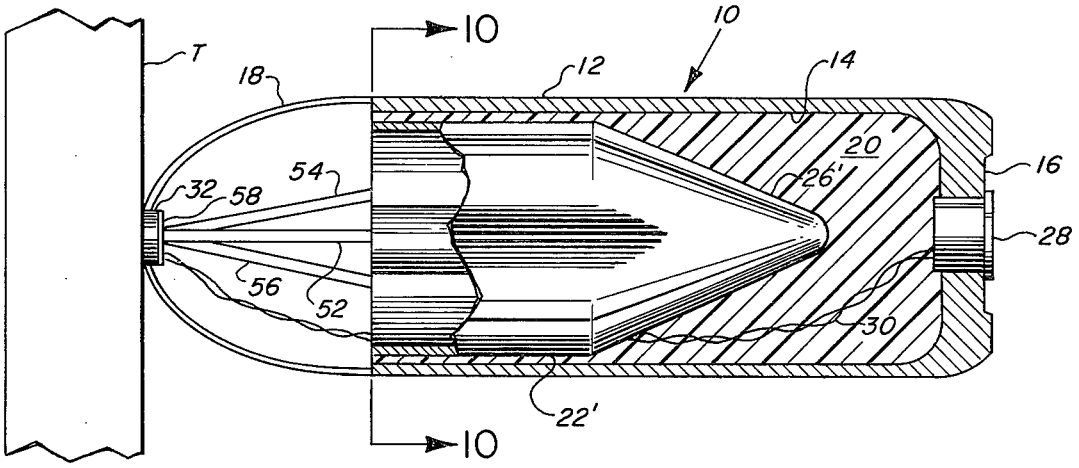
FIG. 9 is a fragmentary sectional view similar to FIG. 1 illustrating a third embodiment.
Figure 10:
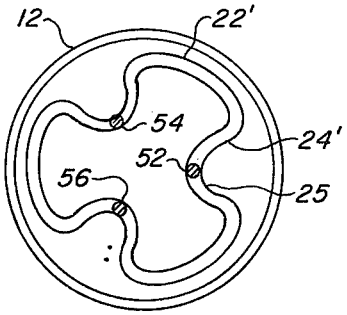
FIG. 10 is a sectional view taken along line 8 — 8 of FIG. 7.
Figure 11:
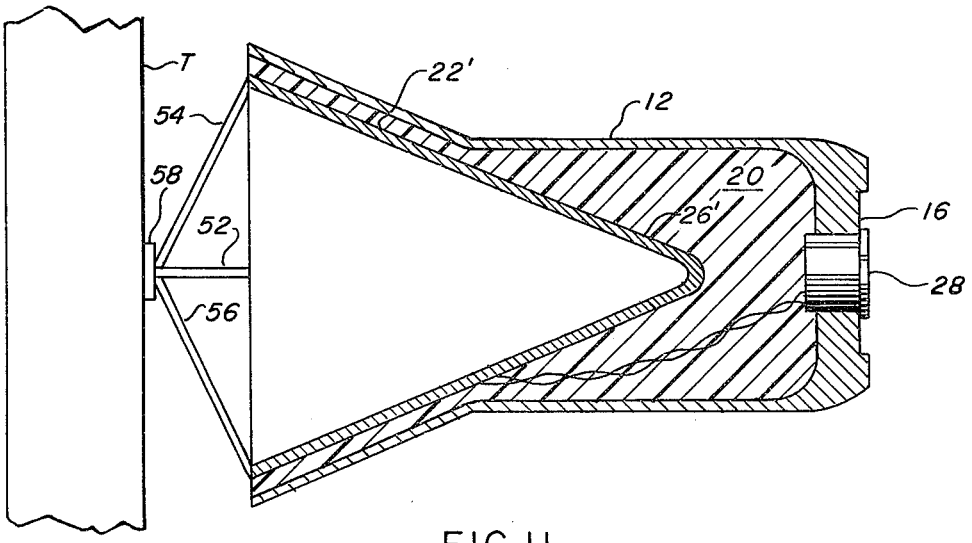
FIG. 11 is a view similar to FIG. 9 illustrating the liner thereof in its expanded position after projectile contact with the target.

A second alternative embodiment is illustrated in FIGS. 9 – 11 wherein the same numerals refer to parts that are the same as the previous embodiments. This embodiment illustrates a simple arrangement where the liner 22′ is expanded by mechanical forces generated upon projectile impact with the target. To this end liner 22′ comprises a plurality of longitudinally extending flutes 24′ terminating in a substantially conicl end 26′ within main charge 20. Suitably affixed to the innermost portions 25 of the flutes 24′ at a point along the length thereof are a plurality of rigid rod-like members 52, 54 and 56. Forwardly of projectile 10 the rods are joined and fixed at a substantially common area of a base plate 58 which is attached to initiating element 32. The arrangement is such that upon impact with the target T the axial force at base plate 58 is translated into radical forces at the points where rods 52, 54 and 56 are secured to the flutes 24′ causing outward expansion and enlargement of the liner 22′ to the substantially enlarged conical shape of FIG. 10. As before, the expansion takes place prior to the firing of the main charge 20 due to the built-in delay of fuze 28 and the resulting enlarged liner provides for a greater penetration of the target than would be the case if no expansion took place.

Although preferred embodiments of the present invention have been illustrated and described, changes will obviously occur to those skilled in the art. For example, it is obvious that a caseless projectile could be employed; in which case, the housing 12 and chamber 14 would be an integral part of the pyrotechnic material 20. Thus, as used herein the term "chamber" is intended to be formed by a separate housing as illustrated or by the outer periphery of a caseless pyrotechnic material. It is, therefore, intended that the scope of the present invention is to be limited only by the scope of the appended claims.

I claim:

1. In an armor penetrating shaped charge having; a generally cylindrical pyrotechnic material, a liner projecting, at least in part, into said pyrotechnic material and having an outer dimension that is at most equal to the outer dimension of said pyrotechnic material, the improvement comprising;

a. means for expanding the liner into a substantially conical shape having an outer dimension greater than said outer dimension of said pyrotechnic material.

2. The device according to claim 1 wherein;

b. said liner is relatively thin walled and forms a recessed volume within said material, and c. said means is located at least partially within said recessed volume.

3. The device according to claim 2, wherein;

d. said means comprises an ignitable pyrotechnic material

4. The device according to claim 3, wherein;

e. said liner is substantially conical in cross-section.

5. The device according to claim 4, wherein;

f. said liner has fluted walls prior to expansion by said means.

6. The device according to claim 2, wherein;

d. said means comprises a movable member having the operative portions thereof located within said recessed volume adjacent the wall of said liner and the actuating portions thereof located exteriorly of said recessed volume and adapted to contact a target whereupon said operative portions engage said wall to force the expansion of said liner.

7. The device according to claim 6, wherein;

e. said liner has fluted walls prior to expansion and relatively smooth conical walls subsequent thereto.

8. The device according to claim 6, wherein;

e. said operative portion comprises a plurality of rigid members.

9. The device according to claim 6, wherein;

e. said operative portion comprises a linearly movable and conically shaped ram.

10. The device according to claim 9, wherein;

f. said actuating portions include a piston and cylinder.

11. The device according to claim 10, wherein;

g. said actuating portions further include a pyrotechnic material located within said cylinder.

12. In an armor penetrating shaped charge having; a generally cylindrical body section defining a pyrotechnic chamber, a pyrotechnic material located in said chamber, a detonator for said pyrotechnic material at one end of said chamber, a liner at the other end of and projecting into said chamber having an outer dimension that is at most equal to the outer dimension of said body section, a hollow windshield attached to the other end of said chamber and a signal generating element on said windshield connected to said detonator, the improvement, comprising;

a. means for expanding the liner into a substantially conical shape having an outer dimension greater than said outer dimension of said body section.

13. The apparatus of claim 12, wherein;

b. said means comprises an ignitable pyrotechnic material.

14. The apparatus of claim 12, wherein;

b. said means comprises a movable member adjacent said liner and actuable upon impact with a target.

15. The apparatus of claim 12, wherein;

b. said means comprises a plurality of rigid members having one end fixed to said liner and having its other ends joined at a common area.

16. The apparatus according to claim 12, wherein;

b. said liner has fluted walls.

* * * * *